US010850379B2

(12) United States Patent
Rodriguez et al.

(10) Patent No.: US 10,850,379 B2
(45) Date of Patent: Dec. 1, 2020

(54) SYSTEM AND METHOD FOR INSTALLING ROOF TILES

(71) Applicant: Daltile Corporation, Dallas, TX (US)

(72) Inventors: Raul Rodriguez, Dallas, TX (US); Rahul Patki, Richardson, TX (US); Terry Adams, Dallas, TX (US); Claudio Caselli, Dallas, TX (US)

(73) Assignee: Daltile Corporation, Dallas, TX (US)

( * ) Notice: Subject to any disclaimer, the term of this patent is extended or adjusted under 35 U.S.C. 154(b) by 0 days.

(21) Appl. No.: 16/805,974

(22) Filed: Mar. 2, 2020

(65) Prior Publication Data

US 2020/0198110 A1 Jun. 25, 2020

Related U.S. Application Data

(63) Continuation of application No. 16/028,806, filed on Jul. 6, 2018, now Pat. No. 10,618,156.

(51) Int. Cl.
*B25C 7/00* (2006.01)
*E04D 1/16* (2006.01)
(Continued)

(52) U.S. Cl.
CPC ..... *B25C 7/00* (2013.01); *E04D 1/16* (2013.01); *E04D 1/34* (2013.01); *E04D 15/02* (2013.01);
(Continued)

(58) Field of Classification Search
CPC ..... B25C 7/00; E04D 1/16; E04D 1/1502; E04D 1/34; E04D 2001/3494; E04D 2001/3423; E04D 1/265
(Continued)

(56) References Cited

U.S. PATENT DOCUMENTS 1,549,723 A 8/1925 Mattison
2,730,969 A 1/1956 Perry
(Continued)

FOREIGN PATENT DOCUMENTS

CN 2173688 Y 8/1994
CN 204401887 U 6/2017
(Continued)

OTHER PUBLICATIONS

ASTM C373-88 (Reapproved 2006); Standard Test Method for Water Absorption, Bulk Density, Apparent Porosity, and Apparent Specific Gravity of Fired Whiteware Products, Feb. 2006, 2 pages.
(Continued)

*Primary Examiner* — Jeanette E Chapman
(74) *Attorney, Agent, or Firm* — Troutman Pepper Hamilton Sanders LLP; James E. Schutz; Chris N. Davis

(57) ABSTRACT

A method for installing a roof tile covering on a roof structure comprising: providing a plurality of roof tiles comprising a porcelain body and an attachment hole above the roof structure; placing and fixing a part of the plurality of roof tiles onto the roof structure, forming a horizontal row; interrupting the horizontal row at a distance from a hip or valley of the roof structure; cutting a roof tile to provide a triangular or trapezoidal piece comprising one or more attachment holes; placing and fixing the triangular or trapezoidal piece onto the roof structure over the hip or valley, leaving a gap between the triangular or trapezoidal piece and the plurality of roof tiles in the horizontal row; and placing and fixing at least one roof tile on the roof structure over the gap, wherein the roof tile covering comprises a plurality of horizontal rows of roof tiles.

18 Claims, 4 Drawing Sheets

(51) Int. Cl.
*E04D 15/02* (2006.01)
*E04D 1/34* (2006.01)

(52) U.S. Cl.
CPC ..... *E04D 2001/3423* (2013.01); *E04D 2001/3494* (2013.01)

(58) Field of Classification Search
USPC ..... 52/748.1
See application file for complete search history.

(56) References Cited

U.S. PATENT DOCUMENTS

| | | | | |
|---|---|---|---|---|
| 3,309,832 | A | 3/1967 | Filsinger | |
| 3,796,618 | A | 3/1974 | Lehming et al. | |
| 3,921,364 | A | 11/1975 | Briles | |
| 4,341,336 | A | 7/1982 | Smith | |
| 4,720,955 | A * | 1/1988 | Kane | E04D 1/18 52/519 |
| 4,787,190 | A | 11/1988 | Papsdorf | |
| 4,844,673 | A | 7/1989 | Kendall | |
| 5,671,577 | A | 9/1997 | Todd | |
| 5,935,885 | A | 8/1999 | Hnat et al. | |
| 6,851,487 | B1 | 2/2005 | Shotey | |
| 6,948,288 | B1 * | 9/2005 | Smith | E04D 12/00 52/309.8 |
| 7,322,505 | B2 | 1/2008 | Ishizawa et al. | |
| 7,596,919 | B1 | 10/2009 | Vande Hey et al. | |
| 7,736,557 | B2 | 6/2010 | Evans et al. | |
| 8,371,072 | B1 | 2/2013 | Shanes et al. | |
| 8,507,098 | B2 | 8/2013 | Long et al. | |
| 9,795,141 | B2 | 10/2017 | Chason et al. | |
| 10,618,156 | B2 * | 4/2020 | Rodriguez | E04D 15/02 |
| 2004/0139822 | A1 | 7/2004 | Gehring et al. | |
| 2004/0173658 | A1 | 9/2004 | Castellanos | |
| 2005/0280183 | A1 | 12/2005 | Itou et al. | |
| 2005/0284339 | A1 | 12/2005 | Brunton et al. | |
| 2007/0215668 | A1 | 9/2007 | Tabacco et al. | |
| 2008/0135094 | A1 * | 6/2008 | Corrales | H01L 31/024 136/259 |
| 2008/0277446 | A1 | 11/2008 | Yamamoto et al. | |
| 2008/0302050 | A1 | 12/2008 | Kalkanoglu | |
| 2009/0255202 | A1 | 10/2009 | Heidennann | |
| 2010/0031594 | A1 | 2/2010 | Liu et al. | |
| 2010/0032086 | A1 | 2/2010 | Hwang | |
| 2012/0085053 | A1 | 4/2012 | Barone | |
| 2012/0148806 | A1 | 6/2012 | Dubey et al. | |
| 2013/0031864 | A1 | 2/2013 | Schools et al. | |
| 2014/0090695 | A1 | 4/2014 | Rodrigues et al. | |
| 2014/0196618 | A1 | 7/2014 | Pervan et al. | |
| 2014/0272296 | A1 | 9/2014 | Fahlsing et al. | |
| 2016/0319554 | A1 | 11/2016 | Thiers et al. | |
| 2017/0218632 | A1 | 8/2017 | Patki et al. | |
| 2017/2018632 | | 8/2017 | Patki et al. | |
| 2018/0112415 | A1 | 4/2018 | Smith et al. | |
| 2018/0290421 | A1 | 10/2018 | Ide | |
| 2020/0009711 | A1 * | 1/2020 | Rodriguez | E04D 1/34 |
| 2020/0048909 | A1 * | 2/2020 | Patki | E04D 1/30 |
| 2020/0198110 | A1 * | 6/2020 | Rodriguez | E04D 1/265 |

FOREIGN PATENT DOCUMENTS

| | | | |
|---|---|---|---|
| DE | 3121111 | A1 | 9/1982 |
| DE | 29619183 | U1 | 12/1996 |
| EP | 0117391 | B1 | 4/1987 |
| EP | 2172600 | A1 | 4/2010 |
| GB | 2456008 | A | 7/2009 |
| JP | H10-194819 | A | 7/1998 |
| JP | 2003193630 | A | 7/2003 |
| WO | 200136882 | A1 | 5/2001 |
| WO | 2013158594 | A1 | 10/2013 |
| WO | 2015034366 | A2 | 3/2015 |
| WO | 2015092745 | A1 | 6/2015 |

OTHER PUBLICATIONS

"Builders' Show: Boral's Hail-Resistant Concrete Rool Tiles," Consumer Reports News, Jan. 24, 2013 [retrieved Jun. 26, 2017]; retreived from the Internet <URL:http://www.boralamerica.com/roofing/about/news/hail-resistant-roof-tiles>, 12 pages.

Griese, B., "Is it Really Porcelain," Feb. 2008 [retrieved Jun. 26, 2017]; retrieved from the Internet <URL:http://www.tcnatile.com/images/pdfs/is%20_%20Really%20Porcelain.pdf>, 2 pages.

International Search Report and Written Opinion for Related International Application No. PCT/US2017/015217, dated Jun. 16, 2017, 10 pages.

"Vivaldi," Lea Ceramiche, Jan. 13 [retrieved Jun. 26, 2017]; retrieved from the Internet <URL:http://www.readingrock.com/sites/default/files/Vivaldi_lux.pdf>, 32 pages.

International Search Report and Written Opinion for International (PCT) Application No. PCT/US2019/040218 dated Oct. 1, 2019.

International Search Report and Written Opinion for International (PCT) Application No. PCT/US2019/045455 dated Nov. 13, 2019.

International Search Report and Written Opinion for International (PCT) Application No. PCT/US2019/039201 dated Sep. 13, 2019.

* cited by examiner

SYSTEM AND METHOD FOR INSTALLING ROOF TILES

CROSS-REFERENCE TO RELATED APPLICATIONS

This application claims priority to U.S. application Ser. No. 16/028,806, filed on 6 Jul. 2018, the disclosure of which is herein incorporated by reference in its entirety.

BACKGROUND

1. Field

The present invention relates to a system for installing roof tile comprising a ceramic body, preferably a porcelain body, and to a method for installing said roof tile. The invention further relates to a porcelain roof tile, i.e. a roof tile comprising a ceramic body and to a roof covering comprising porcelain roof tiles.

2. Background

US 2017/0218632 disclose roof tiles having a body made of porcelain. Such kind of materials improve the weather/frost resistance and durability of the roof tile with respect to other kinds of ceramic materials like red body ceramic, for example terracotta.

In order to form a roof covering, such roof tiles shall be nailed or screwed on a roof structure. Due to the brittleness of porcelain, hammering and nailing of the roof tile can cause breakage of the body thereof. Therefore, during installation of the roof covering a considerable number of roof tiles can be wasted thereby increasing the cost of the roof covering itself, as well as the workload of the installer.

The present invention aims in the first place at an alternative system for installing a roof covering comprising porcelain roof tiles, of the aforementioned type, whereby, according to various preferred embodiments, solutions are offered for problems with roof tiles known in the art.

BRIEF SUMMARY

Thereto, the present invention, according to a first independent aspect, relates to a roof tile installing system that comprises: a roof tile having a ceramic body, preferably made of porcelain, provided with an attachment hole; a nail for being inserted into the attachment hole of the roof tile thereby installing the roof tile to a roof structure; a nail gun for pushing the nail into the through hole; wherein the nail gun has a centering element configured to be coupled with the attachment hole. The inventors have found that due to this solution breakage of porcelain roof tiles can be significantly reduced. In fact, by means of the nail gun it may be ensured that the correct force is exerted onto the roof tile, thereby avoiding the risk of unexpected and unwanted impulses that could lead to ruptures of the roof tile. Moreover, the centering element provides for a correct position of the nail so that the impulse given by the nail gun is properly directed reducing the risk of unexpected and unwanted impulses that could lead to ruptures of the roof tile.

Although a preferred embodiment of the invention is related to a system comprising a nail and a nail gun, it is possible that alternative embodiments may comprise a screw and a screw gun.

According to a preferred embodiment of the present invention the body is made of porcelain since porcelain provides for a better frost and mechanical resistance with respect to other ceramic material. Therefore, the combination of a porcelain body together with other feature of the system provides for a system that minimizes the consumption of roof tiles, in other words minimizes the breakage of roof tile.

Although a porcelain body is a preferred embodiment, it is noted that the system may alternatively comprise a roof tile having a body of a ceramic material, or any other material used for roof covering, especially brittle material like, for example, natural stone or slate.

Preferably the roof tile further comprises a glaze coating, which is situated above said ceramic body, i.e. at least on the upper surface of the ceramic body. Hereby, it is noted that the glaze coating is not necessarily situated directly above the ceramic body, however, this is preferably the case. The glaze coating contributes to the overall weather and frost resistance of the roof tile, since water can mainly only be absorbed via the edges of the roof tile. Another advantage is that the roof tile, due to the presence of the glaze coating, may be provided with a variety of textures, designs and colors. Other advantages that may be obtained by the presence of the glaze coating are the prevention or at least the minimization of moss grow, easy cleanability and/or UV-resistance.

Further, according to an embodiment of the invention, the glaze coating may cover at least one edge of the roof tile, for example three edges of the roof tile. In particular, since the roof tiles are destined to be installed partially overlapping each-other, there will be always one edge, namely an upper edge, that in use will be place below another roof tile and that consequently will not be exposed to weather and water. On the contrary the other three edges will be exposed to weather and water. By providing a glaze coating on said exposed edges is improved the overall weather and frost resistance of the roof tile. Preferably said exposed and glaze edges may be rounded or chamfered edges, for example they may be bullnose edges.

In a preferred embodiment, the glaze coating comprises a glaze layer of uniform color, which, in case of said glaze coating comprising a print, is situated below said print. As advantage, the glaze layer of uniform color may hide imperfections in the upper surface of the ceramic body. Although the glaze layer of uniform color is preferably of a white, beige or grey color, the glaze layer may be of another color as well. In the latter case, the advantage may be obtained that the ink lay-up, which is needed for obtaining the desired colors in the aforementioned print, can be lowered.

Preferably, the glaze coating comprises a transparent or translucent glaze layer, which, in case of said glaze coating comprising a print, is arranged over said print. By having such glaze layer, the advantage may be obtained that the print can be protected from wear. Other advantages that may be obtained by the use of such transparent or translucent glaze layer are the minimization of moss grow, easy cleanability and/or UV-resistance. It is noted that the aforementioned glaze coating may be a so-called wet or dry glaze. In a particular embodiment, the color or appearance of the ceramic body substantially matches the color or appearance of the front face of the roof tile. As advantage, no major color or appearance differences are visible between for example the edges of the ceramic body and the front face of the roof tile.

In a preferred embodiment, said glaze coating comprises a décor, which may simulate a natural product such as stone, natural slate or wood. In the latter case, the décor may show wood grains or wood nerves. As advantage, the roof tile may have the look of a natural product such as natural slate or wood, while being provided with better weather and frost resistance than roof elements that are actually made of such materials. In a particular embodiment, said décor comprises a print. In other words, the décor, or at least part of the décor, is provided by means of a printer or printing machine. Various techniques may be used to provide said print, such as screen printing, rotary serigraphy or digital printing, the latter technique being the preferred one. In case of digital printing, an inkjet printer may be used, which may be of the single pass type. In particular, a device similar to the one disclosed in EP 1 038 689 A1 may be used, wherein each roof tile is printed separately with a single pass of the roof tile underneath the fixed print heads of the device. With such device, the possibility is offered to print in certain areas of the upper surface of the roof tile. For example, the device may be used to print multiple images, each of these images being present in respective areas of the upper surface of the roof tile. These images may be separated from each other by means of intermediate lines, transitions or edges, which are not necessarily provided by means of printing, although this is not excluded.

Preferably, the front face of the roof tile represents or forms an image of a plurality of roof tiles. In such case, the roof covering may have the appearance of a conventional one, however, with the advantage of being composed of fewer roof tiles. That the roof covering is composed of fewer roof tiles allows reducing the overall risk at water penetration. Indeed, the number of joints, present between the roof tiles in the roof covering, in which water might penetrate, may be minimized. For forming such kind of front face, a décor with multiple images may be applied, e.g. with each image representing a single roof tile. These multiple images may be provided by respectively printing in certain areas of the upper surface of the roof tile, as previously described. Thereto, a device such as the device known from EP 1 038 689 A1 may be applied. In such front face, the borders or transitions between adjacent images of roof tiles may be represented by means of a relief.

Preferably, the front face of the roof tile represents or forms an image of a plurality of roof tiles. In such case, the roof covering may have the appearance of a conventional one, however, with the advantage of being composed of fewer roof tiles. That the roof covering is composed of fewer roof tiles allows reducing the overall risk at water penetration. Indeed, the number of joints, present between the roof tiles in the roof covering, in which water might penetrate, may be minimized. For forming such kind of front face, a décor with multiple images may be applied, e.g. with each image representing a single roof tile. These multiple images may be provided by respectively printing in certain areas of the upper surface of the roof tile, as previously described. Thereto, a device such as the device known from EP 1 038 689 A1 may be applied. In such front face, the borders or transitions between adjacent images of roof tiles may be represented by means of a relief. For example, as previously described, these borders or transitions may be formed by means of depressions in the upper surface of the roof tile, situated between the images of the roof tiles.

In case of the glaze coating being provided with a print, it is advantageous that the ceramic body substantially matches the general color or appearance of that print. Indeed, in that way, any substantial contrast between the edges of the ceramic body and the print may be excluded. For accomplishing that goal, the ceramic body may be provided with one or more color pigments. The pigments may then be chosen such that they provide the ceramic body with a color or appearance that substantially matches the color or appearance of the front face of the roof tile. It is noted that, in general, the ceramic body may be provided with one or more color pigments, irrespective of the ceramic body substantially matching the color or appearance of the front face of the roof tile.

According to an alternative embodiment wherein the roof tile comprises a porcelain body, the roof tile may be free from said glaze coating and the body may comprise a body décor. For accomplishing that goal, the ceramic body may be provided with one or more color pigments. The pigments may then be provided into the body randomly or according to a predetermined pattern or drawing. In this way the body décor may represent a natural product such as natural slate or wood. The body décor may also represent multiple images substantially in the same manner described above with reference to the glaze coating.

In an embodiment, the upper surface of the roof tile is provided with a relief, which preferably is formed by a plurality of excavations present in said upper surface of the roof tile. By the relief, the texture of the roof tile, at the upper surface thereof, may simulate the texture of a natural product such as stone, natural slate or wood. In the latter case, the relief may for example simulate the texture of wood grains or wood pores.

The relief or at least part of the relief may also concern one or more chamfers present at the upper surface of the roof tile, which may be provided at one or more edges of the roof tile. For example, the relief or at least part thereof may concern a chamfered perimeter of the roof tile, for example in the form of a bullnose edge. In case of a décor with multiple images, the relief may also be used to represent lines or transitions between these images. For example, these lines or transitions may be represented in the form of depressions in the upper surface of the roof tile, situated between the images. Various possibilities may be applied for providing the relief. Preferably, the relief is formed in the upper surface of the ceramic body, in which case the relief manifests itself through the glaze coating up to the upper surface of the roof tile.

Alternatively, the relief or at least part of the relief may be formed in the glaze coating, such that it is situated substantially or completely above the ceramic body. In case of said glaze coating being provided with a print, said relief may be performed "in register" with said print, which means that the relief is in alignment with the print. By having the relief "in register" with the print, the natural look or appearance of natural products such as wood or natural slate is better simulated. For example, in case the print is a wood pattern with lines simulating wood grains, the relief may be formed by lines following the course of said lines of the printed wood pattern or by a plurality of successive dashes having a configuration following the lines of the printed wood pattern.

For having the relief being performed "in register" with the print, the techniques known from WO 2015/092745 A1 may be used.

In a particular embodiment, the lower surface of the roof tile may be provided with a relief. The relief or at least part of the relief at the lower surface preferably concerns one or more chamfers or tapers present at the lower surface of the roof tile, which may be provided at one or more edges of the roof tile. For example, the relief or at least part thereof may concern a chamfered perimeter at the lower surface of the roof tile.

In a preferred embodiment, the roof tile comprises a reinforcement layer, which is situated below the ceramic body and preferably directly below the ceramic body, although it is not excluded that the reinforcement layer is not situated directly below the ceramic body. It is noted that in the case of the reinforcement layer being situated directly below the ceramic body, it is not excluded that an adhesive layer such as glue is provided between the reinforcement layer and the ceramic body. Said glue could be, for example, an epoxy glue. Because of the reinforcement layer, the advantage is obtained that the roof tile is prevented from falling apart, or that the risk of the roof tile falling apart is at least reduced. Such layer may for instance hold pieces or parts of the roof tile, which are damaged or broken off, due to heavy wind or storm for example, together. Hence, the overall safety of the roof is increased. It is noted that, in case the ceramic body is made of porcelain, such reinforcement layer is particularly advantageous.

Although the porcelain body is very strong, when damage occurs, the body may break in many different parts. Hence, in such situation, it is beneficial that these are kept together such that the roof tile does not fall apart.

Preferably, the reinforcement layer is formed by a mesh, such as a fiberglass mesh. In an alternative, the reinforcement layer is formed by a relatively thin support layer, i.e. a support layer which is thinner than the ceramic body. For example, the thin support layer may be a support slab such as a steel foil. The support slab may be glued to the ceramic body, directly or indirectly, for example in accordance with WO 2010/072704 A1. Preferably, a compression is obtained in the roof tile, resulting into higher impact strength. In this way, high impact hail rating may be obtained, possibly with a reduced thickness of the ceramic body of the roof tile, which may be beneficial to the overall weight of the roof tile.

Preferably, the thickness of the roof tile is between 5 and 20 mm, and more preferably between 7 and 15 mm, whereby a thickness of approximately 12 mm is still more preferred. Such thickness provides a good balance between, on the one hand, the weight of the roof tile, and, on the other hand, the strength of the roof tile. In particular, a thickness of about 12 mm has been found to be beneficial for the hail impact rating of the roof tile 12 mm is a preferred thickness for roof tiles destined to installations where hail impact resistance class 4 is useful or required, whereas in installation wherein said hail impact resistance class 4 is not necessary 8 mm is a preferred value for thickness in order to make a cheaper and lighter roof tile.

In a preferred embodiment, the ceramic body forms at least 50%, more preferably at least 75%, and still more preferably at least 90% of the thickness of the roof tile. In that way, the roof tile has optimal advantage of the beneficial characteristics of porcelain.

The inventors have found that the roof tile may be made relatively wide. For example, the width of the roof tile may be larger than its length. Also, not necessarily combined with the previous, the roof tile may be at least 350 mm wide and preferably at least 500 mm wide. That the roof tile may be made relatively wide, offers the advantage that the roof or roof covering may be composed of a relatively small amount of roof tiles, thereby minimizing the number of joints present in the roof covering and consequently the risk at water penetration. Within the scope of the present application the width of a roof tile is that dimension that in use is intended to be disposed horizontal, i.e. parallel to the roof ridge, whereas the length is that dimension that in use is intended to be disposed inclined according to the slope of the roof.

The roof tile is preferably provided with at least one attachment hole. Such attachment hole is used to attach or fasten the roof tile to a roof structure or framework of the roof, said framework for instance being formed by battens. The attachment hole is a through hole.

As advantage, the attachment hole allows a safe and secure installation of the roof tile, for example by using nails, screws or wires. Moreover, the attachment hole allows a simple and efficient way to install the roof tile.

In an embodiment, the attachment hole is present in at least the ceramic body of the roof tile. Accordingly, for example when using nails or screws, pressure is exerted onto the ceramic body for attaching it to the roof framework. Due to the ceramic body being made of porcelain, the risk at any damage or breakage of the roof tile, resulting from that pressure, may be minimized.

The attachment hole is preferably situated closer to the upper edge of the roof tile than to the lower edge of the roof tile. According to the preferred embodiment, as already described, said upper edge correspond to the width, i.e. the longest edge of the roof tile. The inventors have found that due to this solution the roof or roof covering may be composed of a relatively small amount of roof tiles, thereby minimizing the number of joints present in the roof covering and consequently the risk at water penetration. Still more preferably, the attachment hole is situated at a distance from the upper edge of the roof tile, as measured in the length direction of the roof tile, which is smaller than 0.25 times the length of the roof tile. As advantage, the extent of overlap between adjacent roof tiles in subsequent rows of the roof covering may be minimized.

Preferably, the roof tile is provided with a multiplicity of attachment holes, for example more than 2, preferably 4 or 6. According to the preferred embodiment of the invention, the attachment holes of said plurality are aligned parallel to the upper edge of the roof tile. It is also preferred that an external attachment hole of said plurality, i. e. the attachment hole in proximal position with respect to one the side edge, and preferably both the external attachment holes, are placed at a distance from the respective closest side edge that is less than 60 mm, preferably less than mm, for example less than 35 mm. The inventors have found that due to this solution it is possible to cut the roof tile into triangular or trapezoidal pieces in such a way that at least one hole will be present in said trapezoidal piece, even if the roof tile is cut along a line having an inclination of 22° with respect to the upper edge. The cutting of the roof tile into triangular or trapezoidal pieces is necessary when the roof tile is to be placed close to a hip or valley between two roof flaps. Usually the operator cuts the tile according to the preferred dimension and form and then drills one or more attachment holes on the cut piece. This operation is complex and timewasting especially for roof tiles having a porcelain body because of the hardness of porcelain that makes it difficult to drill. Moreover, it is also possible that the roof tile comprises a couple of external holes proximal to at least one side edge, preferably to each side edge, wherein both of the holes of the couple is placed at a distance from the respective closest side edge that is lower than 60 mm preferably lower than 56 mm, for example lower than 35 mm. In this way, it is possible to cut the roof tile into triangular or trapezoidal pieces in such a way that at least two holes will be present in said trapezoidal piece, even if the roof tile is cut along a line having an inclination of 22° with respect to the upper edge. This provides the further effect that said triangular or trapezoidal piece is fixed to the roof structure with two nails or screw so to prevent rotation of the piece around the nail or screw axis and improving the stability of the piece. The holes of said couple may be aligned parallel to the upper edge of the roof tile or parallel to the side edge thereof.

According to a preferred embodiment of the invention, the attachment hole comprises a first enlarged portion and a second narrow portion, wherein the first enlarged portion is disposed close to the upper surface of the roof tile. The first enlarged portion and the second narrow portion are located coaxially to each other. In this way, the enlarged portion defines a seat for the nail head and at the same time defines a guide for the centering element of the nail gun so that the nail can be properly positioned and directed into the hole minimizing the risk of damaging the roof tile.

The first enlarged portion is configured to be coupled with an ejecting nozzle of the nail gun, preferably with the centering element of the nail gun so that the nail may be properly placed and directed.

According to a preferred embodiment of the invention, the first enlarged portion of the attachment hole has a diameter larger than a head of the nail, whereas the second narrow portion has a diameter smaller than the head of the nail so that between the two portions of the attachment hole is formed an abutment for said head of the nail. For example, the first enlarged portion of the attachment hole comprises a diameter of at least 10 mm for example 15 mm. Further, the second narrow portion of the attachment hole comprises a diameter between 6 and 4 mm, for example between 4.5 and 5.5 mm. According to an embodiment of the invention, the transition between the first enlarged portion and the second narrow portion of the attachment hole is obtained via a curved wall of the attachment hole itself so that the positioning of the nail and of the ejecting nozzle of the nail gun is further enhanced without the risk of damaging the roof tile because of the presence of sharp edges.

In the present example, the first enlarged portion of the attachment hole has a deepness of at least 0.5 mm, for example 1.2 mm.

In a preferred embodiment the first and the second narrow portion of the attachment hole are provided with the glaze coating.

In a preferred embodiment, the roof tile comprises a layer, which is situated below the ceramic body. It is noted that the layer situated below the ceramic body is not necessarily situated directly below the ceramic body, however, this is preferably the case. It is further noted that, in case of said layer being situated directly below the ceramic body, it is not excluded that an adhesive layer such as glue is present between said layer and the ceramic body.

The layer situated below the ceramic body may provide additional functionalities to the roof tile. As advantage, it may be tailored, irrespective of the properties of the ceramic body. As another advantage, the layer may render it possible to reduce the thickness of the ceramic body, which may be beneficial to the overall weight of the roof tile. Still another advantage is that such layer may hold pieces or parts of the roof tile, which are damaged or broken off, due to heavy wind or storm for example, together. Said layer may thus function as a reinforcement layer.

Preferably, said layer situated below the ceramic body is made of a material different from ceramic or porcelain. In particular, said layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said layer, high-density polyethylene or HDPE is preferred, although the use of low-density polyethylene or LDPE is not excluded. In case of said layer situated below the ceramic body being made of a polymer, the layer may comprise a filler, such as an inorganic filler, e.g. chalk, talc or limestone, and/or an organic filler, e.g. wood, cork or bamboo particles. If said layer situated below the ceramic body is made of a polymer, the layer may comprise one or more plasticizers. The one or more plasticizers may be present in an amount of less than 20 phr and, in this case, preferably in an amount between 5 phr and 15 phr. In this case, the layer is of the so-called rigid type. In an alternative, the one or more plasticizers may be present in an amount of minimal 15 phr and, in this case, preferably in an amount of at least 20 phr. In this case, the layer is of the so-called soft type.

In a particular embodiment, said layer situated below the ceramic body may be foamed. Said layer situated below the ceramic body may comprise a reinforcement layer, which is preferably embedded in the layer situated below the ceramic body. The reinforcement layer may concern a fiberglass layer, a mat or a fabric. As advantage, the reinforcement layer allows to increase the mechanical strength of the layer situated below the ceramic body and/or the stability thereof. In a particular embodiment, said layer situated below the ceramic body may comprise mineral fibers, such as glass fibers, which are not necessarily present in said layer situated below the ceramic body in the form of a layer. For example, the mineral fibers may be present in said layer situated below the ceramic body in the form of fibers that are distributed across the layer situated below the ceramic body. The presence of mineral fibers offers the advantage that the mechanical strength and/or stability of the layer situated below the ceramic body may be increased.

The ceramic body and the layer situated below said ceramic body may be laminated or press laminated together, directly or indirectly, for example by means of glue such as epoxy glue.

As mentioned above, due to the presence of said layer, the advantage is obtained that the thickness of the ceramic body may be reduced, however, with maintaining a good strength, durability and/or weather/frost resistance. Preferably, in case such layer is present, the thickness of the ceramic body is located between 25% and 75% of the thickness of the roof tile and more preferably between 40% and 60% of the thickness of the roof tile. The thickness of the layer situated below the ceramic body is preferably located between 25% and 75% and more preferably between 40% and 60% of the thickness of the roof tile.

In an embodiment, at least a part of the layer situated below the ceramic body extends beyond the ceramic body in at least the length direction of the roof tile. For example, the ceramic body and said layer may be offset with respect to each other in at least the length direction of the roof tile. Preferably, at least a part of the layer situated below the ceramic body extends beyond at least the upper edge of the ceramic body. In this case, at least a part of the ceramic body may extend beyond at least the lower edge of said layer. In this way, it is obtained that the ceramic bodies of two of such roof tiles, installed in subsequent rows of the roof covering, may overlap, such that mainly only the ceramic bodies are exposed to outside conditions. This offers the advantage that the roof covering shows good properties in terms of weather and frost resistance. As another advantage, the amount of overlap between the ceramic bodies of two of such installed roof tiles in subsequent rows may be reduced.

In an embodiment, at least a part of the layer situated below the ceramic body extends beyond the ceramic body in at least the width direction of the roof tile. For example, the ceramic body and said layer may be offset with respect to each other in at least the width direction of the roof tile. As advantage, it is obtained that the risk at water penetration may be reduced, since water penetrating the joint between two of such adjacent roof tiles in the same row of the roof covering may be caught by the underlying layers. Preferably, at least a part of the layer situated below the ceramic body extends beyond at least a side edge of the ceramic body, in the direction wherein multiple of such roof tiles are installed in a row of the roof covering. In this case, at least a part of the ceramic body may extend beyond at least a side edge of said layer, in the opposite direction. This provides the additional advantage of ease of installation.

In an embodiment, said part of the layer situated below the ceramic body that extends beyond a side edge of the body comprises channels for the drainage of water.

It is noted that at least part of the layer situated below the ceramic body may extend beyond the ceramic body in the length direction of the roof tile as well as in the width direction of the roof tile. For example, said layer may be offset with respect to the ceramic body in the length direction of the roof tile as well as in the width direction of the roof tile.

Preferably, the upper and lower surface of said layer converge towards each other. In particular, they may converge towards each other in the direction towards the upper edge of said layer. For example, the upper surface of said layer may be substantially parallel to the lower surface of the ceramic body, whereas the lower surface of said layer may be configured such that, in the installed condition of the roof tile, it is substantially parallel to the slope of the roof. As advantage, the risk at breakage or damage of the roof tile, e.g. when walking over it, may be significantly reduced. In a particularly preferred embodiment, the lower surface of said layer is arranged such that, in the installed condition of two of such roof tiles in subsequent rows of the roof covering, the lower surfaces of the respective layers of these two roof tiles form a generally flat surface. In other words, the transition from the lower surface of the layer of one roof tile of these two roof tiles to the lower surface of the layer of the other roof tile is flush or substantially flush. It is noted that in case of such converging surfaces the thickness of said layer varies. In this case, where reference is made to the thickness of said layer, this thickness should be interpreted as the average thickness of said layer. The same applies to the thickness of the roof tile.

In a first possibility for the configuration of the layer situated below the ceramic body, at least a part of said layer extends beyond the ceramic body, which part is provided with one or more attachment holes. As such, the presence of any attachment holes in the ceramic body may be avoided, hereby reducing the risk at breakage or damage of the ceramic body upon installing. The layer may be tailored, irrespective of the ceramic body, such that it is strong enough to withstand any forces or pressure applied on it upon installing. In this regard, the aforementioned materials for the layer are particularly advantageous. In particular, at least a part of said layer may extend beyond the upper edge of the ceramic body, which part is provided with one or more attachment holes.

The one or more attachment holes are preferably situated closer to the upper edge of the roof tile than to the lower edge of the roof tile. Still more preferably, the one or more attachment holes are situated at a distance from the upper edge of the roof tile, as measured in the length direction of the roof tile, which is smaller than 0.25 times the length of the roof tile. As advantage, the extent of overlap between adjacent roof tiles in subsequent rows of the roof covering may be minimized.

It is noted that according to said first possibility the attachment holes may comprise any of the features already described with reference to the ceramic body.

In a second possibility for the configuration of the layer situated below the ceramic body, the ceramic body and said layer are overlapped in a part that is provided with one or more attachment holes, wherein the attachment hole passes through the ceramic body and said layer. For example, the second narrow part of the attachment hole comprises a portion in the ceramic body and a portion in the layer below the ceramic body. According to this configuration the layer situated below the ceramic body can improve the impact resistance thereof acting as a reinforcing member thereby minimizing the risk of breakage during the nailing step. Moreover, since both the ceramic body and the layer below are nailed together to the roof structure the risk of delamination between them, caused by wind lift up, is reduced.

As already said above the nail gun comprises a main body configured for housing means for ejecting a nail and at the same time shaped for being handled by a user. The nail gun comprises an ejecting nozzle for ejecting said nail.

According to the invention the centering element is attachable to the ejecting nozzle of the nail gun. Preferably, the centering element is removably attachable to said ejecting nozzle.

For example, the centering element comprises a first portion configured to be coupled to the ejecting nozzle. For example, said first portion of the centering element may be an annular portion having an internal diameter substantially equal to, preferably slightly larger than, the diameter of the ejecting nozzle. It is noted that, the centering element can comprise securing elements for being removably coupled to said ejecting nozzle. According to an example of the invention the securing elements are in form of bolts. It is noted that alternatives securing means are possible, for example the first portion of the centering element may be threaded and configured to be screwed onto a threaded portion of the ejecting nozzle. According to further examples the first portion may also comprise an adjustable diameter or more in general being configured to be coupled to an ejecting nozzle having a diameter falling into a predetermined range, for example between 15 mm and 25 mm.

The centering element is configured to be coupled with the attachment hole. The centering element has an external shape that matches the internal shape of the through hole so that it may be partially inserted in the through hole. Preferably, the centering element is configured to be coupled with the first enlarged portion of the attachment hole. For example, the centering element has a second portion, preferably having an annular shape, that comprises an internal diameter adapted to eject the nail and an external diameter substantially equal to, preferably slightly smaller than, the diameter of the attachment hole. In particular, according to the preferred embodiment the external diameter of the second portion of the centering element is substantially equal to, preferably slightly smaller than, the diameter of the first enlarged portion of the attachment hole. Moreover, it is clear that the internal diameter second portion of the centering element is larger than the diameter of the second narrow portion of the attachment hole since it shall be larger than the head of the nail.

It is also preferred that the centering element is configured to be coupled with the through hole with a backlash comprised between 0.1 mm and 0.5 mm, for example between 0.2 mm and 0.4 mm. So that the positioning of the centering element is accurate and simple at the same time.

It is noted that due to the preferred configuration of the centering element wherein it comprises a first portion adapted to be coupled to the ejecting nozzle of the nail gun and a second portion adapted to be coupled to the attachment hole of the roof tile, it is possible to provide a set of centering elements wherein the second portions of the centering elements comprise substantially the same dimensions, e.g. the same external and internal diameter, and wherein the firsts portions of the centering elements comprise different dimension, e.g. different internal diameters. In this way given a roof tile with attachment hole having a predetermined dimension the user may chose the centering element of the set that is tailored for a given nail gun.

According to an embodiment of the invention, in order to reduce the solicitation on the roof tile the system may comprise a cushioning element interposed between the head of the nail and the upper surface of the roof tile. For example, the cushioning element may be in form of an O-ring made of an elastomeric material.

According to a first possibility the cushioning element is coupled to the head of the nail. Whereas according to a second possibility the cushioning element is coupled to the roof tile. For example, the cushioning element may at least partially surround the attachment hole. For example, the cushioning element may surround the second narrow portion of the attachment hole and be seated on the abutment formed between the first enlarged portion and the second narrow portion of the attachment hole.

The system may further comprise an under layer disposed beneath the roof tile. The under layer may provide additional functionalities to the roof tile. As advantage, it may be tailored, irrespective of the properties of the ceramic body. Preferably, said under layer is made of a material different from ceramic or porcelain. In particular, said under layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said layer, low-density polyethylene or LDPE is preferred, although the use of high-density polyethylene or HDPE is not excluded.

According to a preferred embodiment of the invention, the under layer is a strip of polymeric material that is placed beneath a plurality of roof tile, in particular it is placed beneath a row of roof tile forming the covering. In this way the under layer is placed below the joints between the roof tiles of a same row thereby improving impermeability of the roof covering. Since the impermeability is improved because of the under layer, it is possible to reduce the overlap between the roof tile and, as a consequence the number of the roof tiles that are necessary for the roof covering. For example, due to this solution the roof tiles may be installed with an overlap of less than 35%, for example less than 25%. This reduced overlap provides for a significantly reduced number of roof tiles that is necessary for forming the roof covering and, as a consequence, for reducing the weight of the roof covering and the cost thereof. In fact the inventors have found that surprisingly a porcelain roof tile installed with said under layer is significantly lighter that an equivalent roof with traditional slate tiles even if slate is less dense than porcelain.

It is noted that said set of centering element for installing a roof tile may form and independent aspect of the invention irrespective of the presence of the nail gun. Therefore according to its second independent aspect the invention provides for a set of centering element for installing a roof tile wherein each centering element comprises a first and a second annular portion, wherein the first annular portion is configured for being coupled to an ejecting nozzle of a nail gun and wherein the second annular portion is configure for being coupled to an attachment hole of a roof tile, and wherein the second annular portions comprise a same external diameter, and wherein each of first annular portion comprises an external diameter that is different from the other firsts annular portions of the centering elements of the set.

It is also noted that the fact that the centering element comprises an adjustable portion may form an independent aspect irrespective from other features of the system. Therefore, according to its third independent aspect, the invention relates to a centering element for a nail gun comprising a first annular portion configured for being coupled to an ejecting nozzle of said nail gun, and a second annular portion, wherein the first annular portion comprises adjustable securing means configured to secure said first annular portion to ejecting nozzles having diameters of different dimension. For example, the adjustable securing means are configured to secure said first annular portion to ejecting nozzles having a diameter falling into a predetermined range, for example between 15 mm and 25 mm.

It is noted that the centering element of any from said second or third independent aspect may comprise one or more of the features of the centering element described in relation to the first independent aspect.

It is also noted that the invention may relate to a roof tile having one or more of the features described above irrespective from the system or the method used for the installation. For example, according to a fourth independent aspect, the invention relates to a roof tile having a ceramic body comprising an attachment hole, wherein the attachment hole comprises a first enlarged portion and a second narrow portion, wherein the first enlarged portion is disposed close to the upper surface of the roof tile.

Moreover, a fifth independent aspect of the invention provides for roof tile having a ceramic body comprising an attachment hole, wherein the roof tile further comprises a cushioning element at least partially surrounding the attachment hole.

Furthermore, a sixth independent aspect of the invention may relate to a roof tile having a ceramic body and a layer placed below the ceramic body, wherein the roof tile comprises an attachment hole passing through the ceramic body and the layer placed below the ceramic body.

It is also noted that the roof tile of any from said fourth to sixth independent aspect may comprise one or more of the features of the roof tile described in relation to the first independent aspect.

A seventh independent aspect of the invention provides for a method for installing a roof tile on a roof structure, comprising the steps of: placing a roof tile having a porcelain body comprising an attachment hole above a roof structure; providing a nail for being inserted in the through hole of the roof tile; providing a nail gun for pushing the installing nail into the attachment hole and having a centering element; coupling the centering element with the attachment hole of the roof tile; pushing the nail into the attachment hole for installing the roof tile on the roof structure. It is noted that the roof tile, the nail gun, and the centering element may comprise one or more of the features described with respect to the first independent aspect.

The method further comprises the step of placing an under layer on the roof structure and subsequently the step of placing the roof tile on the under layer. More preferably, the method comprises the step of placing a plurality of roof tile on the under layer in order to form a row of the roof covering. It is noted that the under layer may comprise one or more of the features described with respect to the first independent aspect.

Preferably the method comprises the step of placing the roof tiles of adjacent horizontal rows on the roof structure in such a way that they are partially overlapped, for example with an overlap from 20% to 35%, for example from 25% to 35%. For example, to achieve this result the roof ties are placed on the roof structure, with the width, that is the longer side, parallel to the roof ridge.

An eighth independent aspect of the invention provides for a method for installing a roof tile covering on a roof structure, comprising the steps of: providing a plurality of roof tile having a porcelain body comprising an attachment hole above a roof structure; placing and fixing part of said roof tiles onto the roof structure thereby forming a horizontal row; interrupting said row at a distance from a hip or valley of the roof structure, wherein said distance is preferably larger than the width of the roof tile; cutting one roof tile to provide a triangular or trapezoidal piece having the attachment hole; placing and fixing said triangular or trapezoidal piece onto the roof structure substantially in correspondence of said hip or valley thereby leaving a gap from the roof tiles of the horizontal row; placing and fixing at least one roof tile on the roof structure in correspondence of said gap thereby filling the gap itself.

Preferably, the step of the method according to the eighth independent aspect are repeated for each row of the roof the roof covering.

Preferably said step of cutting comprises cutting along a first cutting line that is inclined with respect to the upper edge, preferably of an angle 22°. Moreover, said step of cutting provides a triangular or trapezoidal piece having a plurality of attachment holes. According to an embodiment of the invention said step of cutting is repeated to provide a plurality of triangular or trapezoidal pieces having the same form and dimension, so that once the form and dimension of the first piece is determined the cutting operation is repeated to provide all the pieces that are needed for all the rows of the same roof flap, thereby speeding up the installation process.

Preferably, said step of placing and fixing said triangular or trapezoidal piece may comprise the step of gluing the triangular or trapezoidal piece to the roof structure. It is also possible that the triangular or trapezoidal piece may be both nailed or screwed and glued to the roof structure.

The step of placing and fixing for filling the gap may comprise a step of cutting the roof tile along a second cutting line parallel to the side edge of the roof tile, thereby providing a narrowed roof tile having a width adjusted to the width of the gap.

Any of the methods according to the seventh or eighth independent aspect may comprise the step of placing the roof tiles of adjacent horizontal rows on the roof structure with an offset pattern, for example with a regular offset, e.g. 50% offset or 30% offset, although a random offset is preferred. the random offset is especially preferred in case it is necessary to cut the roof tile to obtain the narrow roof tile for filling the gap. In fact, in case of regular offset, in correspondence of the narrowed tile there can be a visible irregularity of the offset pattern that will affect the global aspect of the roof covering, whereas in case of random offset the global aspect of the roof covering may not be affected.

It is noted that any of the steps of placing and fixing may comprise one or more of the features described in relation to the seventh independent aspect.

The invention may also relate to a roof covering comprising a plurality of roof tiles wherein each roof tiles comprises one or more of the features described above.

BRIEF DESCRIPTION OF THE FIGURES

With the intention of better showing the characteristics of the invention, in the following, as an example without any limitative character, several preferred forms of embodiments are described with reference to the accompanying drawings, wherein.

DETAILED DESCRIPTION

Figure 1:
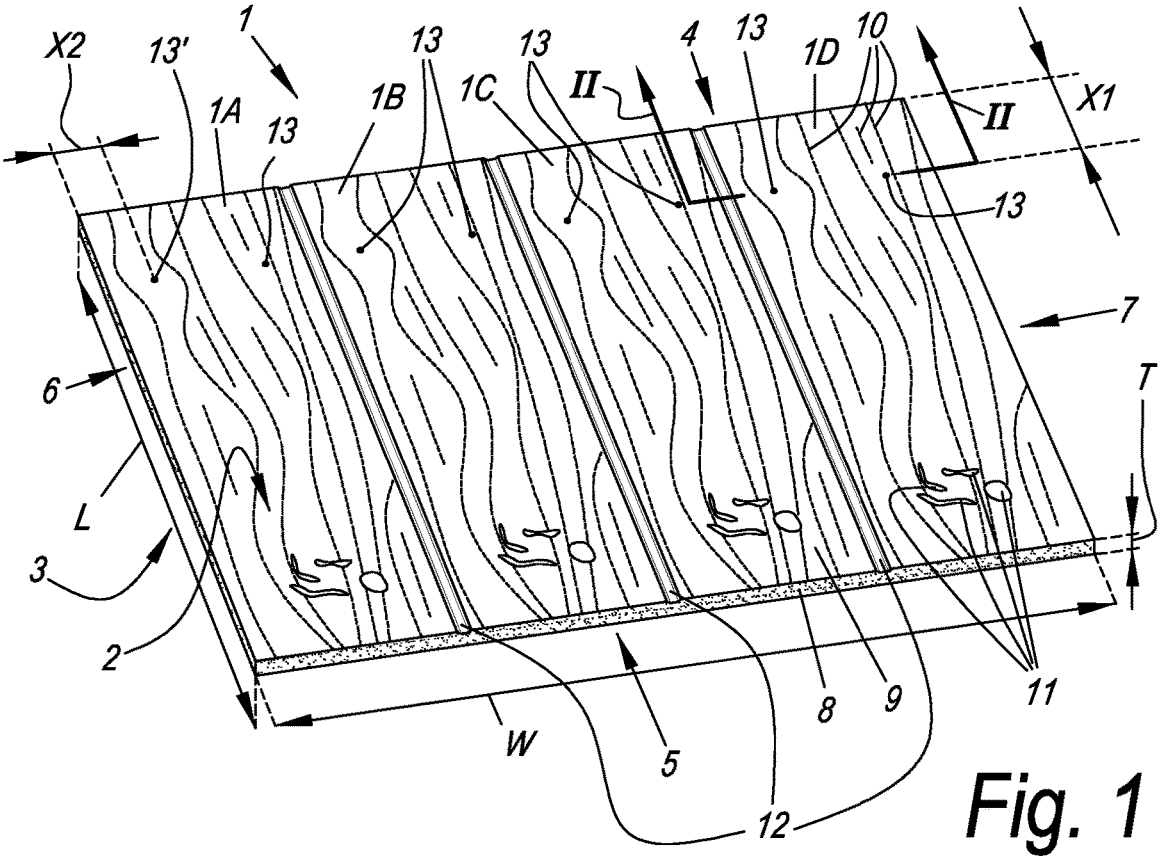
FIG. 1 represents a perspective view of a roof tile according to the present invention, with a view on the front face of the roof tile.

To facilitate an understanding of the principles and features of the various embodiments of the invention, various illustrative embodiments are explained below. Although exemplary embodiments of the invention are explained in detail as being systems and methods for cleanable and slip resistant tile, it is to be understood that other embodiments are contemplated, such as embodiments employing other types of surfaces, coatings, tiles, or tile manufacturing methods. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a,"

"an," and "the" do not denote a limitation of quantity, but rather denote the presence of "at least one" of the referenced item.

As used herein, the term "and/or" may mean "and," it may mean "or," it may mean "exclusive-or," it may mean "one," it may mean "some, but not all," it may mean "neither," and/or it may mean "both." The term "or" is intended to mean an inclusive "or."

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose. It is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

FIG. 1 represents a perspective view of a roof tile 1 according to the present invention, with a view on the front face of the roof tile 1. The roof tile 1 is mainly rectangular and, in the represented example, rectangular and oblong. It has an upper surface 2 and a lower surface 3, whereby, in the installed condition of the roof tile 1, the upper surface 2 is directed upwards, whereas the lower surface 3 is directed downwards. The upper surface 2 forms the decorative surface of the roof tile 1.

Furthermore, the roof tile 1 has an upper edge 4 and a lower edge 5, whereby, in the installed condition of the roof tile 1, the upper edge 4 is directed towards the top of the roof, whereas the lower edge 5 is directed towards the bottom of the roof. Also, the roof tile 1 has two opposite side edges 6-7.

The roof tile 1 comprises a ceramic body 8, which is made of porcelain, and a glaze coating 9, which is situated above said ceramic body 8.

The glaze coating 9 comprises a décor, which here simulates wood. In particular, the décor shows wood nerves 10 and wood pores 11.

In the represented example, the front face of the roof tile 1 represents or forms an image of a plurality of roof tiles 1A-1B-1C-1D. The borders or transitions between the roof tiles 1A-1B-1C-1D are formed by depressions 12, which form part of the relief at the upper surface 2 of the roof tile 1.

Although, in the represented example, the front face of the roof tile 1 represents or forms an image of four roof tiles 1A-1B-1C-1D, it is not excluded that less than four roof tiles are represented, such as two or three roof tiles, nor is it excluded that more than four roof tiles are represented.

The thickness T of the roof tile 1 is preferably located between 5 and 20 mm, more preferably between 7 and 15 mm, and still more preferably the thickness T of the roof tile 1 is approximately 8 mm or 12 mm. 12 mm is a preferred thickness T for roof tiles destined to installation wherein a hail impact resistance class 4 is useful or required, whereas in installation wherein said hail impact resistance class 4 is not required 8 mm is a preferred value for thickness T in order to make a cheaper and lighter roof tile 1.

The width W of the roof tile 1 is larger than its length L. The width W of the roof tile 1 may be at least 250 mm and preferably at least 500 mm.

The roof tile 1 is provided with at least one attachment hole 13,13'. Here, the roof tile 1 is provided with a plurality of attachment holes 13,13'. The attachment holes 13,13' are present in at least the ceramic body 8 of the roof tile 1. They are situated closer to the upper edge 4 of the roof tile 1 than to the lower edge 5 of the roof tile 1. In particular, the attachment holes 13,13' are situated at a distance X1 from the upper edge 4, measured in the length direction of the roof tile 1, which is smaller than 0.25 times the length L of the roof tile 1. The minimal width or diameter of the attachment holes 13,13' is smaller than the thickness T of the roof tile 1.

Among the attachment holes 13,13' the roof tile comprises external attachment holes 13' placed in proximal position with respect the side edges 6,7 and central attachment holes 13 placed distal from the side edges 6. Preferably each external attachment hole 13' is placed at a distance X2 from the respective closest side edge that is less than 60 mm, preferably less than 55 mm, for example less than 35 mm.

In a not represented embodiment, the lower surface 3 of the roof tile 1 may be provided with a relief, such as a chamfer or taper present at one of the edges 4-7 of the roof tile 1, at the lower surface 3. Preferably, the chamfer or taper is present at least at the lower edge 5 of the roof tile 1. Such chamfer at the lower edge 5 offers the advantage of the roof tile 1, according to a view on the lower edge 5, looking relatively thin, e.g. looking like a thin slate roof element, while being provided with better weather and frost resistance than roof elements that are actually made of such materials like slate.

Figure 2:
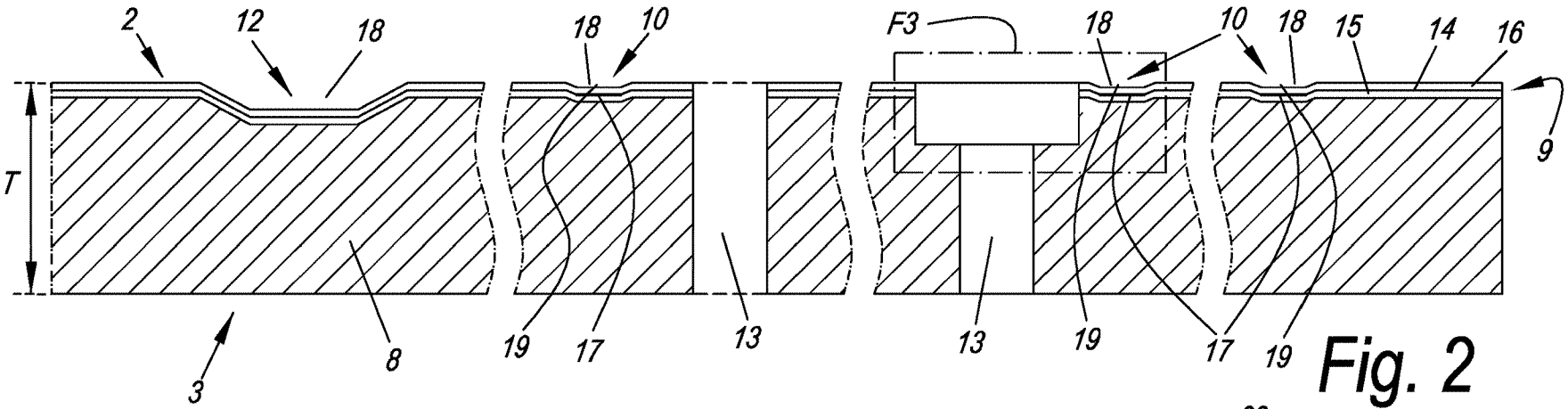
FIG. 2 represents an enlarged cross-section according to line II-II in FIG. 1.

FIG. 2 represents an enlarged cross-section according to line II-II in FIG. 1.

The glaze coating 9 comprises a décor, said décor comprising a print 14, a glaze layer 15 of uniform color, which is situated below the print 14, and a transparent or translucent glaze layer 16, which is arranged over said print 14. It is noted that according to alternative examples the glaze coating 9 may be free from said transparent or translucent glaze layer 16 and/or from said print 14. In further alternative embodiments a glaze coating may absent and the print 14 and the relief may be provided at the upper surface 2 of the ceramic body 8. It is also noted that the glaze coating 9 may comprise a print 14 at least partially provided above said transparent or translucent glaze layer 16.

The print 14 is at least partially formed by lines 17 simulating the wood nerves 10. The upper surface 2 of the roof tile 1 is provided with a relief, which, in the represented example, is formed by a plurality of excavations 18 present in said upper surface 2. According to the present embodiment the relief is formed in the ceramic body 8 and manifest itself through the glaze coating 9, although according to non-showed embodiments the relief may be at least partially formed directly in the glaze coating 9.

In the represented example, by the relief, the texture of the roof tile 1, at the upper surface 2 thereof, simulates the texture of wood. In particular, the relief simulates the texture of the wood nerves 10 and the wood pores 11. For example, the relief is at least partially formed by lines 19 simulating the wood nerves 11.

Here, the relief is also used to represent the borders or transitions between the roof tiles 1A-1B-1C-1D, which, as aforementioned, are formed by the depressions 12 in the upper surface 2 of the roof tile 1.

In the example, the relief is performed in register with the print 14. For example, the lines 19 of the relief follow the course of the lines 17 of the print 14.

The attachment hole 13,13' is a through hole that passes through the entire thickness T of the roof tile 1.

Figure 3:
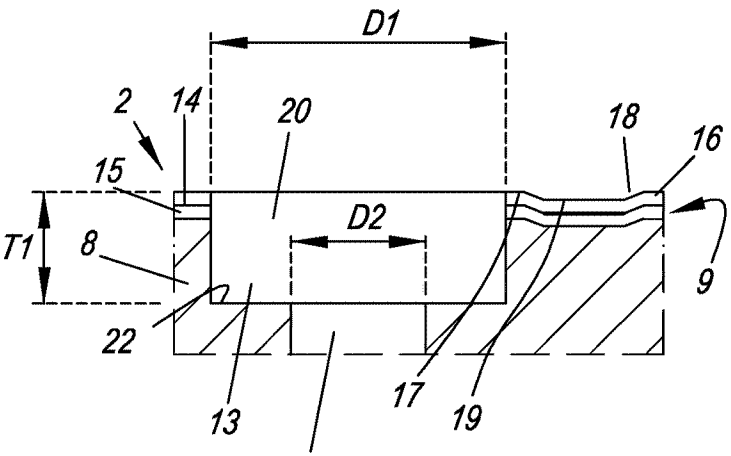
FIG. 3 represents an enlarged view of the section that is indicated with F3 in FIG. 2.

FIG. 3 represents an enlarged view of the section that is indicated with F3 in FIG. 2.

The attachment hole 13,13' comprises a first enlarged portion 20 and a second narrow portion 21, wherein the first enlarged portion 20 is disposed close to the upper surface 2 of the roof tile 1. Between said first enlarged portion 20 and said second narrow portion 21 is formed an abutment 22 that defines a seat for a head of a nail as it will be described below.

In the present example, the first enlarged portion 20 of the attachment hole 13,13' comprises a diameter D1 of at least 10 mm, for example 13 mm. The second narrow portion 21 of the attachment hole 13,13' comprises a diameter D2 between 4 and 6 mm, for example between 4.5 and 5.5 mm.

In the present example, the first enlarged portion 20 of the attachment hole 13,13' has a depth T1 of at least 0.5 mm, for example 1.2 mm.

Figure 4:
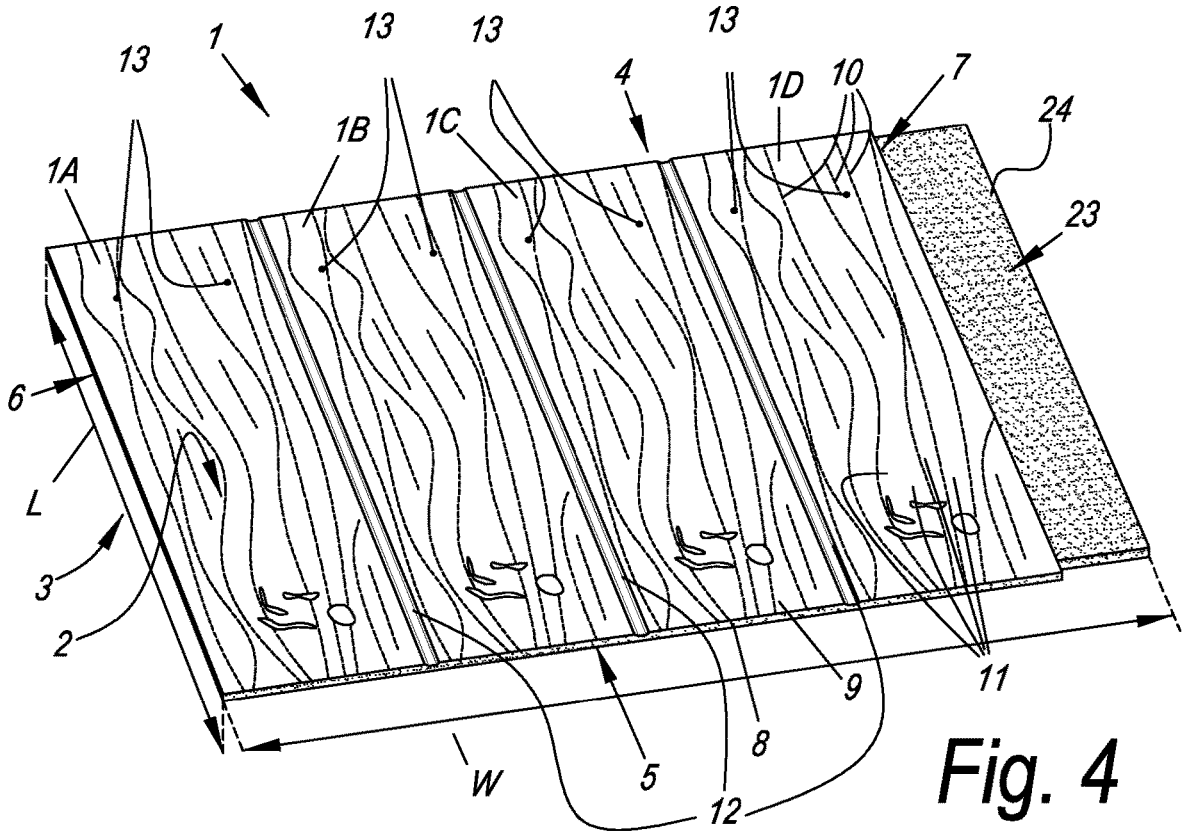
FIG. 4 represents a perspective view of an alternative roof tile according to the present invention, with a view on the front face of the roof tile.

FIG. 4 represents a perspective view of an alternative roof tile 1 according to the present invention, with a view on the front face of the roof tile 1.

The roof tile 1 comprises a layer 23, which is situated below the ceramic body 8.

Said layer 23 is preferably made of a material different from ceramic or porcelain. In particular, it preferred that said layer 23 is made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. The layer 23 and the ceramic body 8 are offset with respect to each other in the width and/or length direction of the roof tile 1. The layer 23 has a part 24 which extends beyond the ceramic body 8. In the represented example, the part 24 extends beyond one side edge 7 of the ceramic body 8. Further, in the present embodiment the ceramic body 8 extends beyond the side edge 31 of said layer 23 that is opposite to the part 24. Moreover, the ceramic body 8 extends beyond a lower edge of said layer 23.

The attachment holes 13,13' passes through the thickness of the layer 23. In particular, the second narrow portions 131 of the attachment holes 13,13' are partially formed in the layer 23.

The layer 21 and the ceramic body 8 may be laminated or press laminated together, for example by means of glue such as epoxy glue.

The ceramic body 8 forms between 25% and 75% of the thickness T of the roof tile 1 and preferably between 40% and 60% of the thickness T of the roof tile 1. The layer 21 forms between 25% and 75% of the thickness T of the roof tile 1 and preferably between 40% and 60% of the thickness T of the roof tile 1.

Figure 5:
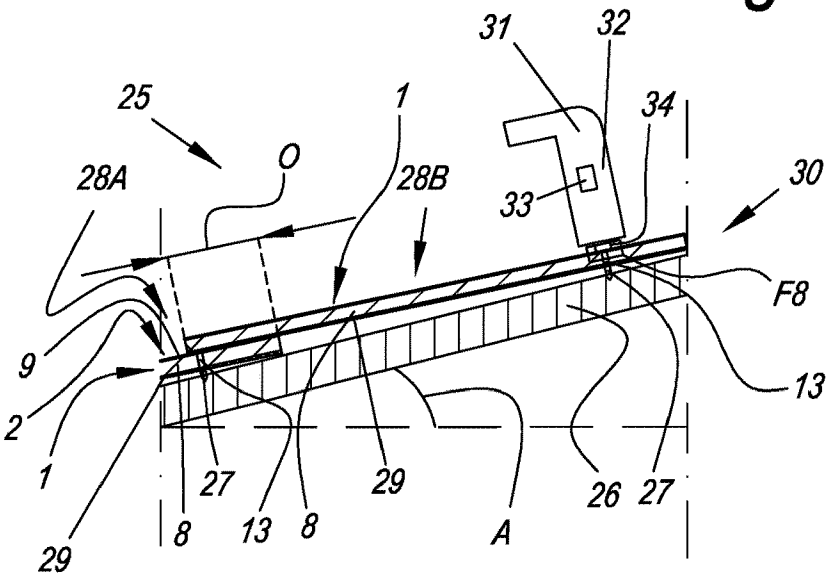
FIG. 5 represents a cross-sectional side view of part of an installed roof covering with roof tiles according to FIG. 1.

FIG. 5 represents a cross-sectional side view of part of an installed roof covering 25 with roof tiles 1 according to FIG. 1.

The roof tiles 1 are attached or fastened to a framework 26 by means of nails 27, which are put in the attachment holes 13,13'.

Figure 7:
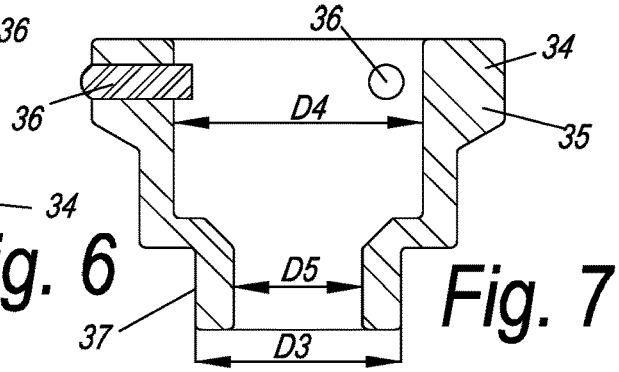
FIG. 7 represents a cross-section according to line VII-VII in FIG. 6.

The roof tiles 1 are installed in subsequent rows, of which only a few are represented in FIG. 7, namely the subsequent rows 28A-28B-28C. In particular, the roof tiles 1 are installed such that the roof tiles 1 of one row partially overlap the roof tiles of a previous row. For example, the roof tiles 1 of row 28C and 28B respectively overlap the roof tiles 1 of previous row 28B and 28A.

The overlap O between the roof tiles 1 of the respective rows is less than 20%. Or, in other words, the roof tiles 1 of row 28C and 28B respectively overlap the roof tiles 1 of previous row 28B and 28A, whereby the overlap O is such that less than 35% of the upper surface 2 of the roof tiles 1 of row 28A and 28B is covered by the roof tiles 1 of row 28B and 28C respectively.

The roof covering 25 comprises a plurality of under layers 29, in form of strips placed beneath a row 28A-28B-28C of roof tile. In particular, each strip of under layer 29 is placed beneath one row 28A-28B-28C. Said under layer 29 is made of a material different from ceramic or porcelain. In particular, said under layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said layer, low-density polyethylene or HDPE is preferred, although the use of high-density polyethylene or LDPE is not excluded.

A denotes the inclination of the roof with respect to the horizontal.

It is noted that the structure of the glaze coating 9 is not represented in detail in FIG. 5.

FIG. 5 also show an example of use of a system 30 for installing the roof tile of FIG. 1 thereby forming said roof covering 25.

The system 30 comprises a nail gun 31 for pushing the nail 27 into the attachment hole 13,13'. The nail gun 31 comprises a main body 32 configured for housing means 33 for ejecting the nail 27. The main body 32 of the nail gun 31 is further shaped for being handled by a user.

The nail gun 31 further comprises a centering element 34 configured to be coupled with the attachment holes 13,13' of the roof tiles 1.

Figure 6:
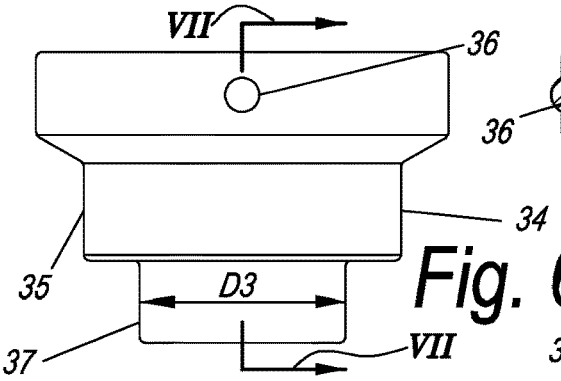
FIG. 6 represents a side view of a centering element according to the invention.

It is noted that the structure of the nail gun 31 is not represented in detail in FIG. 5. FIG. 6 represents a side view of a centering element 34 according to the invention.

In the present embodiment the centering element 34 comprises a first annular portion 35 configured to be removably coupled to an ejecting nozzle of the nail gun 31. For example, the centering element 34 further comprises securing elements 36 for securing the first annular portion 35 to the ejecting nozzle. In the present embodiment, the securing elements 36 are in the form of a plurality of securing bolts. According to alternative examples the securing elements 36 may be in different forms, for example the first annular portion 35 may be threaded and be adapted to be screwed on a threaded portion of the ejecting nozzle.

The centering element 34 further comprises a second annular portion 37 configured to be coupled with the attachment hole 13,13'. For example, the second annular portion 37 is configured to be at least partially inserted into the first enlarged portion 20 of the attachment hole 13,13'. The second annular portion 37 has external diameter D3 substantially equal to, preferably slightly smaller than, the diameter D1 of the first enlarged portion 20 of the attachment hole 13,13'.

FIG. 7 represents a cross-section according to line VII-VII in FIG. 6.

In the present embodiment, the first annular portion 35 has an internal diameter D4 substantially equal or slightly larger than the external diameter of the ejecting nozzle (not shown here, see FIGS. 8 and 9) so that they can be coupled each-other.

It is noted that the second annular portion 37 of the centering element 34 comprises an internal diameter D5 that is larger than the diameter D2 of the second narrow portion 21 of the attachment hole 13,13' since it is necessarily larger than an of the nail 27.

It is noted that, according to the example shown in FIG. 7, the securing elements 36 are adjustable, that is to say that they are configured to couple said first annular portion 35 to ejecting nozzles having a diameter falling into a predetermined range, for example between 15 mm and 25 mm. For example, the position of the securing elements 36 may be adjusted with respect to said first annular portion 35 according to the dimension of the ejecting nozzle.

Figure 8:
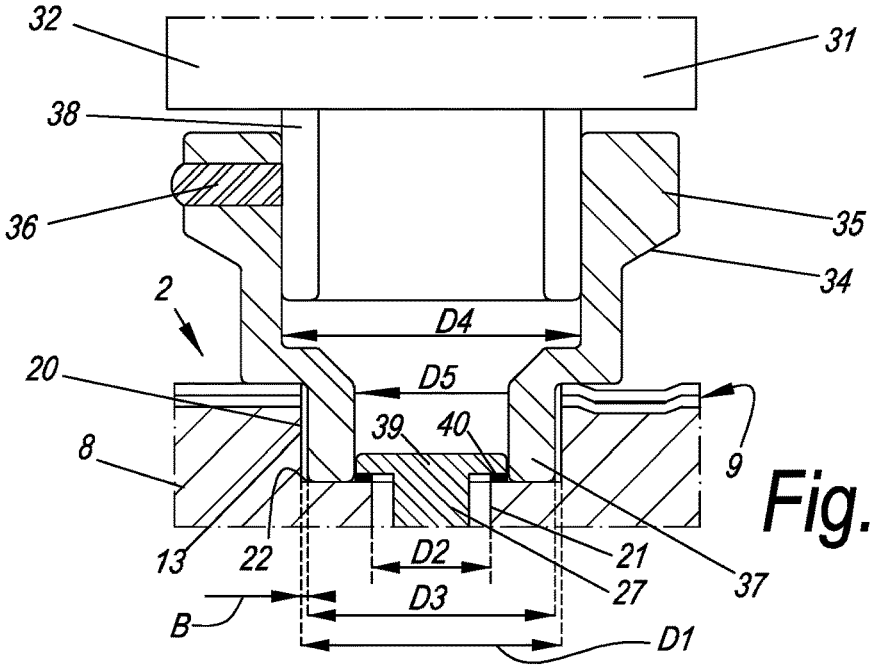
FIG. 8 represents an enlarged view of the section that is indicated with F8 in FIG. 5.

FIG. 8 represents an enlarged view of the section that is indicated with F8 in FIG. 5.

It is noted that FIG. 8 further represent a step of a method for installing the roof covering 25.

The centering element 34 is removably attached to the ejecting nozzle 38 of the nail gun 31 by means of its first annular portion 35 and the securing means 36.

The second annular portion 37 of the centering element 34 is inserted into the attachment hole 13,13'.

It is noted that the second annular portion 37 of the centering element 34 and the first enlarged portion 20 of the attachment hole 13,13' are coupled with a backlash B comprised between 0.1 mm and 0.5 mm, for example between 0.2 mm and 0.4 mm.

The nail 27 has been pushed by the nail gun 31 into the attachment hole 13 via the centering element 34.

The system 30, according to the example showed in FIG. 8, also comprises a cushioning element in form of an O-ring 40 interposed between the head 39 of the nail 27 and the abutment 22. For example, the O-ring 40 is made of an elastomeric material.

According to this example the O-ring 40 is fixed to the head 39 of the nail 27.

Figure 9:
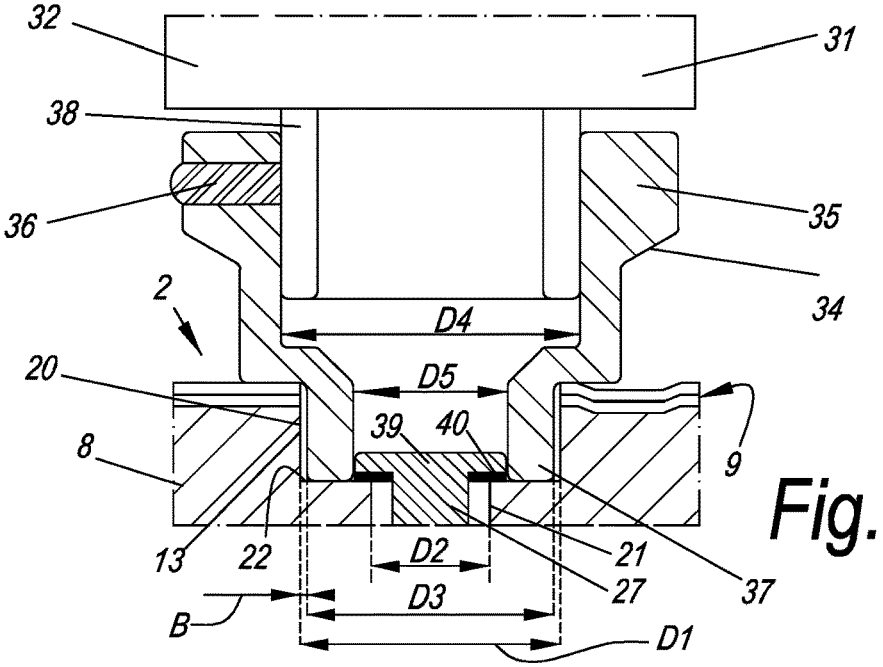
FIG. 9 represents an enlarged view of the section that is indicated with F8 in FIG. 5 according to an alternative system.

FIG. 9 represents an enlarged view of the section that is indicated with F8 in FIG. 5 according to an alternative system.

The system 30, according to the example showed in FIG. 9, comprises an alternative cushioning element in form of an O-ring 40 interposed between the head 39 of the nail 27 and the abutment 22. For example, the O-ring 40 is made of an elastomeric material.

According to this example the O-ring 40 is fixed to the abutment 22 of the attachment hole 13,13' of the roof tile 1.

With reference to the FIGS. 5 and 8, the installing method according to the invention, comprises the step of: placing the roof tile 1 above the framework 26; providing a nail gun 31 for pushing the nail 27 into the attachment hole 13,13'; couple the centering element 34 to the ejecting nozzle 35 of the nail gun 31; inserting the second annular portion 37 of the centering element 34 into the first enlarged portion 20 of the attachment hole 13,13'; pushing the nail 27 into the attachment hole 13,13' via the nail gun 30, thereby installing the roof tile 1.

Figures from 10A to 10E show some steps of a method for installing a roof tile covering 25 on a roof structure 26.

It is noted that the roof structure 26, as well as the top surface of the roof tiles 1, is illustrated in a simplified manner, i.e. non-detailed, for easiness of description.

The roof structure 26 comprises a hip 41, for example between two roof flaps, having an inclination B with respect to the horizontal.

Figure 10A:
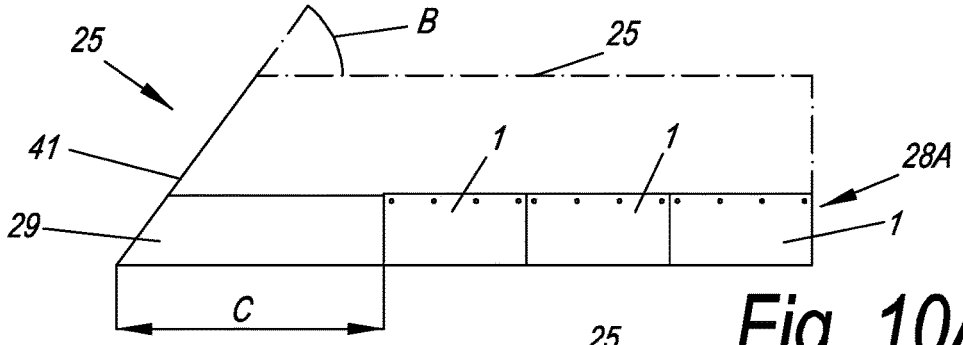
FIGS. 10A-10E show some steps of a method for installing roof tiles on a roof structure.

FIG. 10A shows a first step of the method, wherein a plurality of roof tiles 1 are provided. A first part of said the roof tiles 1 are placed and fixed onto the roof structure 26 in order to form a first horizontal row 28A. Said first horizontal row 28A is interrupted at a distance C from the hip 41. C is equal or larger than the width W of the roof tile 1.

In the illustrated embodiment the roof tiles 1 of the first horizontal row 28A are placed above a strip of the under layer 29.

Figure 10B:
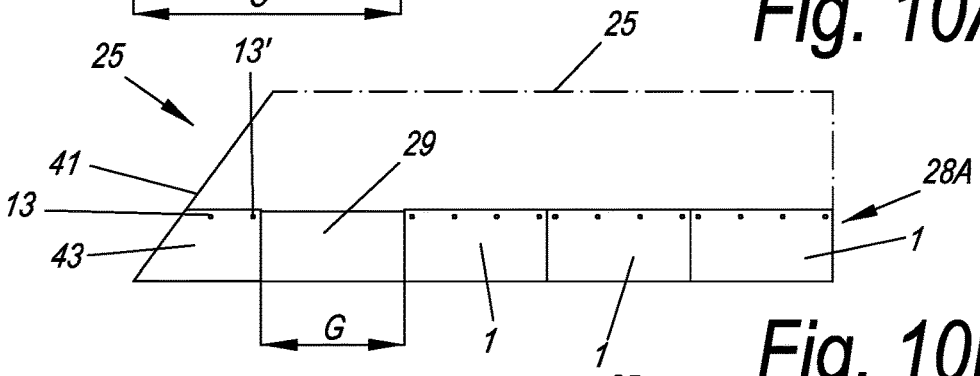

FIG. 10B shows a second step of the method wherein one of said roof tile 1 is cut along a line inclined with respect to the long side of an angle equal to the inclination B of the hip 41 in order to obtain a trapezoidal piece 43 having at least one, preferably two, attachment hole 13,13'. Said trapezoidal piece 43 placed and fixed onto the roof structure 26 substantially in correspondence of said hip 41 thereby leaving a gap G from the roof tiles 1 of the first horizontal row 28A.

Figure 10C:
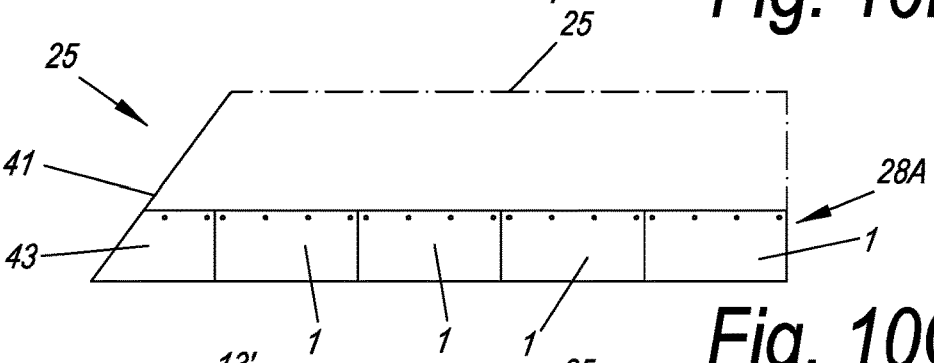

FIG. 10C shows a third step of the method wherein one roof tile 1 is placed and fixed onto the roof structure 26 in correspondence of said gap G thereby filling the gap G itself so that the first horizontal row 28A of the roof covering 25 is completed.

Figure 10D:
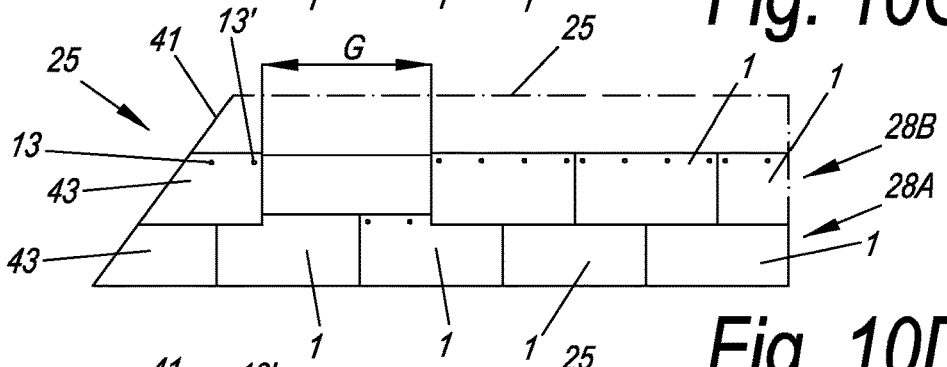

FIG. 10D shows that the first and second steps are repeated for forming a second horizontal row 28B of the roof covering 2. It is noted that the gap G is larger than the width W of one roof tile 1.

Figure 10E:
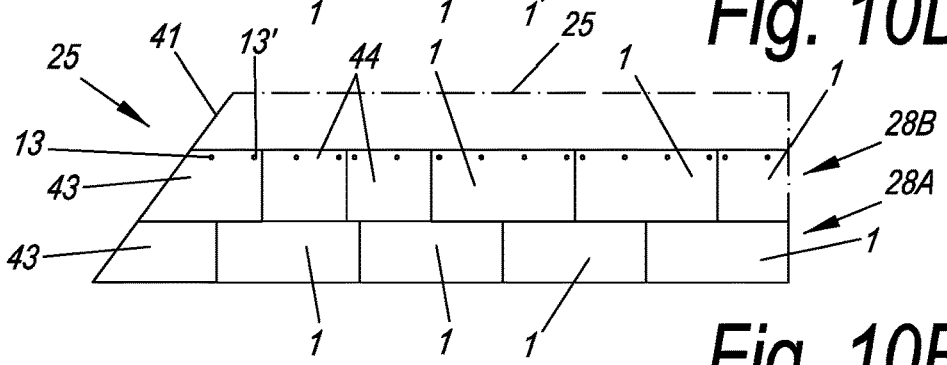

FIG. 10E shows a further step of the method wherein the two roof tiles 1 are cut into two rectangular pieces 44 having at least one, preferably two, attachment hole 13,13'. Said rectangular pieces 44 are placed and fixed onto the roof structure 26 in correspondence of said gap G thereby filling the gap G itself so that the second horizontal row 28B of the roof covering 25 is completed.

The present invention is in no way limited to the hereinabove described embodiments, but such system may be realized according to different variants without leaving the scope of the present invention.

Further, the present invention relates to one or more of the items as listed below, numbered from 1 till 14:

1. A porcelain roof tile installing system that comprises: a roof tile having a porcelain body provided with an attachment hole; a nail for being inserted into the attachment hole of the rooftile thereby installing the roof tile to a roof structure; a nail gun for pushing the nail into the attachment hole; wherein the nail gun has a centering element configured to be coupled with the attachment hole.

2. The system according to item 1, wherein the centering element comprises an external shape that matches the internal shape of the attachment hole so that it may be partially inserted in the attachment hole.

3. The system according to item 2, wherein the centering element is configured to be coupled with the attachment hole with a backlash comprised between 0.1 mm and 0.5 mm.

4. The system according to item 2, wherein the attachment hole comprises a first enlarged portion and a second narrow portion and wherein the centering element is configured to be coupled with the first enlarged portion of the attachment hole.

5. The system according to any of the preceding items, wherein the centering element is removably mounted on an ejecting nozzle of the nail gun.

6. The system according to any of the preceding items, wherein it comprises a cushioning element configured to be interposed between a head of the nail and an upper surface of the roof tile.

7. The system according to item 6, wherein the cushioning element is fixed to the nail.

8. The system according to item 6, wherein the cushioning at least partially surrounds the attachment hole.

9. The system according to any of the preceding items, wherein the roof tile comprises a layer disposed below the porcelain body.

10. The system according to item 9, wherein said layer disposed below the porcelain body is made of a polymeric material.

11. The system according to item 9, wherein the attachment hole passes also through the layer disposed below the porcelain body.

12. The system according to item 8, wherein the said layer extends beyond at least one edge of the porcelain body.

13. The system according to any of the preceding items, that comprises a sub layer made of a material that is different from the material of the roof tile and that is adapted to be placed beneath the roof tile.

14. A method for installing a roof tile on a roof structure, comprising the steps of:

placing a roof tile having a porcelain body comprising an attachment hole above a roof structure;

providing a nail for being inserted in the attachment hole of the roof tile;

providing a nail gun for pushing the nail into the attachment hole and having a centering element;

coupling the centering element with the attachment hole of the roof tile; and pushing the nail into the attachment hole for installing the roof tile on the roof structure.

While certain systems and methods related to composite tile systems and methods have been disclosed in some exemplary forms, many modifications, additions, and deletions may be made without departing from the spirit and scope of the system, method, and their equivalents. The embodiments disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other devices, methods, and systems for carrying out the several purposes of the embodiments and claims presented herein. It is important, therefore, that the claims be regarded as including such equivalent constructions.

What is claimed is:

1. A method for installing a roof tile covering on a roof structure comprising the steps of:

providing a plurality of roof tiles comprising a porcelain body above the roof structure, the porcelain body comprising an attachment hole;

placing and fixing a part of the plurality of roof tiles onto the roof structure thereby forming a horizontal row;

interrupting the horizontal row at a distance from a hip or valley of the roof structure, wherein the distance is larger than the width of the roof tile;

cutting at least one roof tile to provide a triangular or trapezoidal piece comprising one or more attachment holes;

placing and fixing the triangular or trapezoidal piece onto the roof structure substantially in correspondence of the hip or valley thereby leaving a gap between the triangular or trapezoidal piece and the plurality of roof tiles in the horizontal row; and placing and fixing at least one roof tile on the roof structure in correspondence of the gap thereby filling the gap itself, wherein the roof tile covering comprises a plurality of horizontal rows of roof tiles.

2. The method of claim 1, wherein all of the steps are repeated for each of the plurality of horizontal rows of the roof tile covering.

3. The method of claim 1, wherein the cutting step comprises cutting along a first cutting line that is inclined with respect to an upper edge of the roof tile.

4. The method of claim 1, wherein the cutting step provides a triangular or trapezoidal piece comprising a plurality of attachment holes.

5. The method of claim 1, wherein the cutting step is repeated to provide a plurality of triangular or trapezoidal pieces having the same form and dimension.

6. The method of claim 1, wherein the placing and fixing the triangular or trapezoidal piece comprises gluing the triangular or trapezoidal piece to the roof structure.

7. The method of claim 6, wherein the placing and fixing the triangular or trapezoidal piece further comprises nailing or screwing the triangular or trapezoidal piece to the roof structure.

8. The method of claim 1, wherein the step of placing and fixing the at least one roof tile for filling the gap comprises cutting one of the roof tiles along a second cutting line parallel to a side edge of the roof tile.

9. The method of claim 1 further comprising a step of placing the roof tiles of adjacent horizontal rows on the roof structure with a regular offset pattern.

10. The method of claim 1 further comprising a step of placing the roof tiles of adjacent horizontal rows on the roof structure with a random offset pattern.

11. The method of claim 1 further comprising the step of placing the roof tiles of adjacent horizontal rows on the roof structure in such a way that the adjacent horizontal rows are partially overlapped.

12. The method of claim 1 further comprising a step of placing an under layer on the roof structure.

13. The method of claim 1 further comprising:

providing a nail for being inserted in the attachment hole of the roof tile;

providing a nail gun for pushing the nail into the attachment hole, the nail gun comprising a centering element;

coupling the centering element with the attachment hole of the roof tile; and pushing the nail into the attachment hole for installing the roof tile on the roof structure.

14. The method of claim 3, wherein the first cutting line is inclined at an angle of 22° with respect to the upper edge of the roof tile.

15. The method of claim 9, wherein the offset pattern is a regular offset pattern.

16. The method of claim 15, wherein the regular offset pattern is a 50% offset pattern.

17. The method of claim 11, wherein the partial overlap between the adjacent horizontal rows is from 20% to 35%.

18. The method of claim 12 further comprising a step of placing the roof tile on the under layer immediately following the step of placing the under layer on the roof structure.

* * * * *